US009374638B2

(12) United States Patent
Petersen et al.

(10) Patent No.: US 9,374,638 B2
(45) Date of Patent: Jun. 21, 2016

(54) METHOD OF PERFORMING AN RECD MEASUREMENT USING A HEARING ASSISTANCE DEVICE

(71) Applicant: Oticon A/S, Smørum (DK)

(72) Inventors: Svend Oscar Petersen, Smørum (DK); Jesper Nøhr Hansen, Smørum (DK); Jesper Hansen, Smørum (DK); Thomas Kaulberg, Smørum (DK); Michael Smed Kristensen, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/477,384

(22) Filed: Sep. 4, 2014

(65) Prior Publication Data

US 2015/0063614 A1 Mar. 5, 2015

(30) Foreign Application Priority Data

Sep. 5, 2013 (EP) ..... 13183259

(51) Int. Cl.

| | |
|---|---|
| ***H04R 29/00*** | (2006.01) |
| ***H04R 3/00*** | (2006.01) |
| ***H04R 25/00*** | (2006.01) |
| *H04R 1/10* | (2006.01) |

(52) U.S. Cl.

CPC ..... *H04R 3/002* (2013.01); *H04R 25/30* (2013.01); *H04R 25/45* (2013.01); *H04R 1/1016* (2013.01); *H04R 25/70* (2013.01); *H04R 2225/025* (2013.01)

(58) Field of Classification Search

CPC .... H04R 25/30; H04R 25/305; H04R 25/453; H04R 2225/025; H04R 2225/83; H04R 25/70

See application file for complete search history.

(56) References Cited

U.S. PATENT DOCUMENTS 6,792,114 B1 * 9/2004 Kates ..... H04R 25/305 381/60
7,634,094 B2 * 12/2009 Reber ..... A61B 5/12 381/312

(Continued)

FOREIGN PATENT DOCUMENTS

| | | | |
|---|---|---|---|
| EP | 1 594 344 | A2 | 11/2005 |
| EP | 1 830 602 | A1 | 9/2007 |
| WO | WO 2013/075255 | A1 | 5/2013 |

OTHER PUBLICATIONS

Search Report issued in European Patent Application No. 13183259.4, dated Dec. 16, 2013.

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

The application relates to a hearing assistance device and to a method of performing a real ear measurement. The method comprises providing a first controlled acoustic feedback path from an output transducer to a measurement input transducer via a standard acoustic coupler; generating a first probe signal; estimating and storing a first estimate of the first controlled acoustic feedback path; and providing a second controlled acoustic feedback path from the output transducer to the measurement input transducer via the residual volume between the ITE part of the hearing aid device and the user's eardrum; generating a second probe signal; estimating and storing a second estimate of the second controlled acoustic feedback path; and determining a real ear to coupler difference from said first and second acoustic feedback estimates. An alternative and relatively simple method of determining an RECD-value in hearing assistance device of a particular user is thereby provided.

17 Claims, 7 Drawing Sheets

(56) References Cited

U.S. PATENT DOCUMENTS

| | | | | |
|---|---|---|---|---|
| 8,315,402 | B2 * | 11/2012 | Zhang | H04R 19/04 381/322 |
| 2006/0045282 | A1 | 3/2006 | Reber | |
| 2007/0009107 | A1 | 1/2007 | Lange | |
| 2008/0260192 | A1 * | 10/2008 | Yanz | H04R 25/70 381/330 |
| 2010/0166198 | A1 | 7/2010 | Perman | |
| 2014/0321657 | A1 * | 10/2014 | Stirnemann | H04R 25/70 381/60 |

* cited by examiner

METHOD OF PERFORMING AN RECD MEASUREMENT USING A HEARING ASSISTANCE DEVICE

TECHNICAL FIELD

The present application relates to hearing assistance devices and related methods, in particular to the fitting of a hearing assistance device to a particular user. The disclosure relates specifically to a method of performing a real ear measurement in a hearing assistance device. The application furthermore relates to a hearing assistance device and to its use.

The application further relates to a data processing system comprising a processor and program code means for causing the processor to perform at least some of the steps of the method.

Embodiments of the disclosure may e.g. be useful in applications such as fitting of a hearing assistance device to a particular user's needs.

BACKGROUND

The following account of the prior art relates to one of the areas of application of the present application, hearing aids, and in particular to the fitting of hearing aids to a particular user's needs.

A fitting rationale (algorithm) is used by a hearing care professional (HCP, e.g. an audiologist) to determine gain versus frequency for a particular hearing impairment and a particular person (ear/hearing aid). A fitting algorithm, such as NAL-RP, NAL-NL2 (National Acoustic Laboratories, Australia), DSL (National Centre for Audiology, Ontario, Canada), ASA (American Seniors Association), etc., is generally used for this purpose. Among the inputs to such fitting algorithms are hearing threshold or hearing loss data (e.g. based on an audiogram), comfort level, for the user in question, type of hearing aid, etc. Further, a so-called real-ear-to-coupler difference (RECD) measure can be used to fine tune the gain setting, in particular for children (and in particular for relatively closed fittings comprising an ear mould). RECD is defined as the difference in dB as a function of frequency between a sound pressure level (SPL) measured in the real-ear (of the particular user) and in a standard 2 $cm^3$ (often written as 2-cc) acoustic coupler, as produced by a transducer generating the same input signal in both cases. Since the ear canal of a user varies with age (in particular during growth of a child, but also for adults), RECD values vary as a function of frequency as well as time (e.g. age).

When a hearing care professional wants to perform a real ear measurement, it is known (cf. e.g. U.S. Pat. No. 7,634,094) that it can be done easier and faster by using the hearing aid itself to perform the measurement. U.S. Pat. No. 7,634,094 teaches a method for measuring an audio response of a real ear using the microphone of a hearing aid of the user. In that way, it is not necessary to use additional equipment, and for some types of measurements (e.g. RECD measurements) it is considered more precise, since the acoustic environment of the hearing aid (comprising a customized housing (mould)), when performing the measurement, is identical to the acoustical environment, when normally using the hearing aid.

The problem for any type of real ear measurements is to eliminate the noise, and get better signal to noise ratio (SNR). Any improvement of the SNR will result in a more reliable, and probably also a faster, measurement, if less averaging of measurements are needed.

SUMMARY

The present disclosure suggests the use of a feedback estimation system of a hearing assistance device in the RECD measurement.

The feedback estimation system is adapted to estimate the feedback path from an output transducer (e.g. a speaker/receiver) to a measurement input transducer (e.g. a microphone) of the hearing assistance device. A feedback estimation system (when operating in the time domain) estimates an impulse response of the transmission path from the output transducer to the measurement input transducer. A feedback estimation unit may alternatively be operated in the frequency domain and provide a feedback path estimate in the frequency domain (e.g. at a number of predefined frequencies).

In a real ear measurement system using the hearing assistance device (comprising an ITE part, e.g. an ear mould, adapted for being located at or in an ear canal of a user), where the target is to measure the RECD, it is important to measure the difference between the SPL in the real ear and in a standard 2-cc coupler. This can be done according to the present disclosure (exemplified by a feedback estimation unit operating in the time domain) by comparing a) the impulse response of a particular output signal through the output transducer of the hearing assistance device while acoustically connected (e.g. via tubing) to a standard 2-cc coupler and the acoustic signal being picked up by a microphone of the hearing assistance device (or, if the hearing assistance device comprises a Direct Audio Input (DAI), by a microphone of an adapter, connected to the hearing assistance device via the DAI) acoustically connected (e.g. via a thin probe tube) to the same 2-cc coupler, with b) the impulse response of the same particular output signal through the output transducer of the hearing assistance device (or a similar hearing assistance device) comprising the ITE part while mounted at or in the user's ear (e.g. in the form of an ear mould customized to the user's ear, possibly acoustically connected to another part of the hearing assistance device) and the acoustic signal being picked up by a microphone of the hearing assistance device (or by a microphone connected to the hearing assistance device via a DAI) acoustically connected to the residual volume between the ITE part (e.g. comprising the ear mould) of the hearing assistance device and the eardrum of the user (e.g. via a probe tube inserted into the ear canal next to the ear mould).

The idea is to compare the impulse response in the ear with the 2-cc coupler.

An object of the present application is to provide an alternative scheme for measuring a real ear to coupler difference.

Objects of the application are achieved by the invention described in the accompanying claims and as described in the following.

A Method:

In an aspect of the present application, an object of the application is achieved by a method of performing a real ear measurement in a hearing assistance device comprising an ITE part adapted for being located at or in an ear canal of a user, the hearing assistance device comprising a measurement input transducer for converting an input sound signal to an electric input signal, an output transducer for converting an electric output signal to an output sound, a feedback estimation unit for estimating an acoustic feedback path from the output transducer to the measurement input transducer, a memory for storing one or more acoustic feedback estimates, a processing unit operatively connected to the memory, and a probe signal generator for generating a probe signal, the probe signal generator being operatively connected to the output transducer, at least in a specific probe signal mode. The method comprises, a1) providing a first controlled acoustic feedback path from the output transducer to the measurement input transducer via a standard acoustic coupler;

b1) generating a first probe signal;

c1) estimating and storing a first estimate of the first controlled acoustic feedback path (in said memory); and a2) providing a second controlled acoustic feedback path from the output transducer to the measurement input transducer via the residual volume between the ITE part of the hearing aid device and the user's eardrum;

b2) generating a second probe signal;

c2) estimating and storing a second estimate of the second controlled acoustic feedback path (in said memory); and e) determining a real ear to coupler difference from said first and second acoustic feedback estimates.

An advantage of the disclosure is that an alternative and relatively simple method of determining an RECD-value using inherent components (or algorithms) of the hearing assistance device is provided.

The provision of the first and second controlled acoustic feedback paths is known in the art, as e.g. described in U.S. Pat. No. 7,634,094 or in US2007009107A1.

In an embodiment, the standard acoustic coupler is a 2-cc coupler.

In an aspect, the steps a1), b1) and c1) relating to measurements on a standard coupler may be performed at a different point in time and/or using another (similarly fitted) hearing assistance device (preferably of identical type) than steps a2), b2) and c2). In an aspect, the result of steps a1), b1) and c1), providing a first estimate of the first controlled acoustic feedback path, is stored in the memory prior to performing steps a2), b2), c2), e). In an embodiment, a number of first estimates of the first controlled acoustic feedback path corresponding to different resulting output gains (reflecting different possible user needs) are stored in the memory when the hearing assistance device is fitted to a particular user. In an embodiment, step e) comprises e') determining a real ear to coupler difference from said first and second acoustic feedback estimates by comparing a relevant one of the stored number of first estimates of the first controlled acoustic feedback path, the relevant one corresponding most closely to the output gains requested for the current user, with (a currently determined) second estimate of the second controlled acoustic feedback path.

In an embodiment, the method comprises estimating (such as adaptively estimating) an acoustic feedback path from the output transducer to the measurement input transducer.

In an embodiment, the method of estimating an acoustic feedback path comprises operating in the time domain to estimate an impulse response for a signal transmitted from the output transducer to the measurement input transducer. In an embodiment, the method of estimating an acoustic feedback path comprises operating in the frequency domain to provide an estimate of the transfer function of the feedback path at a number of (e.g. predefined) frequencies.

In an embodiment, the feedback estimation unit for estimating an acoustic feedback path provides first and second impulse responses of said first and second controlled acoustic feedback paths, respectively, and the method comprises the step of comparing said first and second impulse responses.

In an embodiment, the hearing aid device comprises a time to frequency conversion unit for converting a time domain signal to a frequency domain signal, the time to frequency conversion unit being operatively connected to the feedback estimation unit. In an embodiment, the feedback estimation unit is adapted to provide an estimate of the impulse response of the current acoustic feedback path, and the method comprises steps d1) and d2) after respective steps c1) and c2), steps d1) and d2) comprising d1) converting a first impulse response of said first controlled acoustic feedback path to a first frequency domain signal; and d2) converting a second impulse response of said second controlled acoustic feedback path to a second frequency domain signal; respectively.

In an embodiment, the feedback estimation unit for estimating an acoustic feedback path provides first and second estimates of the transfer functions of the first and second controlled acoustic feedback paths, respectively, at a number of (e.g. predefined) frequencies. In an embodiment, the method comprises the step of comparing the first and second transfer functions at a number of (e.g. predefined) frequencies.

In an embodiment, the frequency conversion unit comprises a Fourier transformation unit for providing values of the magnitude and optionally phase of the frequency domain signal at a number of frequencies. In an embodiment, the Fourier transformation unit is a DFT-unit providing a discrete Fourier transform of an input signal. In an embodiment, the Fourier transformation unit is adapted to use fast Fourier transform (FFT) algorithms in the Fourier transformation.

In an embodiment, the real ear to coupler difference is determined at different frequencies based on the difference between said first and second frequency domain signals at different frequencies.

In general, the first and second probe signals are identical (time variation/frequency content, level, etc.). Further, the output transducer converting the probe signal to an acoustic output sound is assumed to be identical in the reference coupler measurement and the real ear measurement. Preferably, the RECD values are appropriately compensated for any non-standard properties of the acoustic system constituted by the hearing assistance device, the acoustic transducers and coupling elements as is known in the art. Such fine tuning of the RECD measurement is not considered essential to the main idea of the present disclosure, and will not be specifically dealt with.

In an embodiment, the first or second probe signal is a broad band signal. In the present context, the term 'a broad band signal' is taken to mean that the signal comprises a range of frequencies $\Delta f$ from a minimum frequency $f_{min}$ to a maximum frequency $f_{max}$. Preferably, $\Delta f$ constitutes a substantial part of the frequency range considered by the hearing assistance device, e.g. at least an octave, or at least 25% of the active bandwidth of the hearing assistance device, e.g. the full frequency range considered by the hearing assistance device (e.g. up to 6 kHz or 8 kHz or more).

In an embodiment, the first or second probe signals comprise a pure tone stepped sweep, and wherein for each pure tone frequency, the magnitude of a frequency domain signal representing the feedback path estimate at that frequency is determined. In the present context, the term 'a pure tone stepped sweep' is taken to mean that a number ($N_{pt}$) of pure tones are successively played at different points in time (e.g. with a predefined time interval) and for each pure tone frequency, the magnitude of a frequency domain signal representing the feedback path estimate at that frequency is determined.

In an embodiment, the steps a1) to d1) and a2) to d2) are performed for the first and second controlled acoustic feedback paths, respectively, for each pure tone frequency $f_x$, x=1, 2, . . . , $N_{pt}$, where $N_{pt}$ is the number of pure tones. Preferably, the pure tones are distributed over the active frequency range Δf (between $f_{min}$ and $f_{max}$), e.g. evenly, or at predefined frequency considered of particular importance to the RECD-measurement. Together, the feedback path estimates determined at the number ($N_{pt}$) of pure tones represent an estimate of the feedback path in question over frequency.

In an embodiment, the level(s) of the first and second probe signals is/are controlled in dependence of the current noise level around the hearing assistance device. In an embodiment, first and second probe signal levels are adapted to provide a constant (e.g. predefined) probe signal to noise ratio.

In an embodiment, the first and second controlled acoustic feedback paths, comprise first and second acoustic output propagation elements from the acoustic output of the output transducer to the standard acoustic coupler and to the residual volume, respectively, and first and second acoustic input propagation elements from the standard acoustic coupler and from the residual volume, respectively, to the acoustic input of the measurement input transducer. In an embodiment, the acoustic transfer functions for said first and second acoustic output propagation elements and for said first and second acoustic input propagation elements are known (e.g. determined by measurement). Preferably, the acoustic transfer functions of said first and second acoustic output propagation elements are equal, and the acoustic transfer functions of said first and second acoustic input propagation elements are equal. This has the advantage that the real ear to coupler difference at a given frequency (to a first approximation) can be determined as the difference between the estimated first and second acoustic feedback paths at that frequency.

A Hearing Assistance Device:

In an aspect, a hearing assistance device comprising an ITE part adapted for being located at or in an ear canal of a user, the hearing assistance device comprising a measurement input transducer for converting an input sound signal to an electric input signal, an output transducer for converting an electric output signal to an output sound, a feedback estimation unit for estimating an acoustic feedback path from the output transducer to the measurement input transducer, a memory for storing one or more acoustic feedback estimates, a processing unit operatively connected to the memory, and a probe signal generator for generating a probe signal, the probe signal generator being operatively connected to the output transducer, at least in a specific probe signal mode, the hearing assistance device being adapted to be connected to first and second acoustic propagation elements to said output transducer and to said measurement input transducer, respectively is furthermore provided by the present application. The memory comprises an estimate (such as one or more estimates) of a reference acoustic feedback path via a standard coupler, and the hearing assistance device—in said specific probe signal mode—is configured to initiate a feedback measurement by feeding the probe signal to the output transducer and receiving a resulting feedback signal by said measurement transducer, and to—after a certain convergence time—store in said memory an estimate of the current acoustic feedback path determined by said feedback estimation unit, and to determine a real ear to coupler difference from said reference feedback path and said estimate of the current acoustic feedback path.

It is intended that some or all of the process features of the method described above, in the 'detailed description of embodiments' or in the claims can be combined with embodiments of the device, when appropriately substituted by a corresponding structural feature and vice versa. Embodiments of the device have the same advantages as the corresponding method.

In an embodiment, the feedback estimation unit is configured to adaptively estimate an acoustic feedback path from the output transducer to the measurement input transducer. In an embodiment, the feedback estimation unit comprises an adaptive filter (or other functional element comprising an adaptive algorithm). In an embodiment, the adaptive filter comprises a) a variable filter part for providing a predetermined transfer function based on variable filter coefficients, and b) an adaptive algorithm part for determining update filter coefficients using stochastic gradient algorithms, e.g. Least Mean Square (LMS) or Normalized LMS (NLMS) algorithms.

In an embodiment, the feedback estimation unit is configured to operate in the time domain to estimate an impulse response for a signal transmitted from the output transducer to the measurement input transducer. In an embodiment, the feedback estimation unit is configured to operate in the frequency domain to provide a feedback path estimate at a number of predefined frequencies.

In an embodiment, the hearing assistance device comprises a time to frequency conversion unit for converting a time domain signal to a frequency domain signal. In an embodiment, the time to frequency conversion unit is operatively connected to the feedback estimation unit.

In an embodiment, the feedback estimation unit is adapted to provide an estimate of an impulse response of the current acoustic feedback path. In an embodiment, the time to frequency conversion unit is coupled to the feedback estimation unit to provide a feedback path estimate at a number of predefined frequencies from the estimate of an impulse response of the current acoustic feedback path.

In an embodiment, the hearing assistance device comprises first and second acoustic propagation elements to constitute or form part of controlled feedback paths. In an embodiment, the first acoustic propagation element is configured to guide sound from an acoustic output of the output transducer to a standard acoustic coupler or to a residual volume between said ITE-part and the user's eardrum. In an embodiment, the second acoustic propagation element is configured to guide sound from an acoustic output of a standard acoustic coupler or from the residual volume between the ITE-part and the user's eardrum to an acoustic input of the measurement input transducer. In an embodiment, an acoustic propagation element comprises a tube, preferably comprising appropriate fitting elements (if necessary) to provide a (acoustically) tight fit to the acoustic outputs and inputs in question (e.g. to the output transducer, to the measurement input transducer, to the standard acoustic coupler). Preferably, the second acoustic propagation element is configured to provide an acoustic coupling to the residual volume that does not substantially change a normal acoustic coupling of the residual volume with the environment.

In an embodiment, the first and second acoustic propagation elements are coupled between the output transducer and the residual volume (or standard coupler), and between the residual volume (or standard coupler) and the microphone input, respectively, when the hearing assistance device is in the specific probe signal mode.

In an embodiment, the memory comprises magnitude values at different frequencies of a reference acoustic feedback path. In an embodiment, the hearing assistance device is configured to compare an estimate of a current acoustic feedback path with an estimate of a reference acoustic feedback path at different frequencies. In an embodiment, the reference acoustic feedback path is a controlled feedback path established via a standard acoustic coupler, e.g. a 2-cc coupler. In an embodiment, the current acoustic feedback path is a controlled acoustic feedback path established via the residual volume between the ITE part of the hearing aid device and the user's eardrum. In an embodiment, the hearing assistance device is configured to determine an RECD value at different frequencies based on said estimate of a current acoustic feedback path with said estimate of a reference acoustic feedback path.

In an embodiment, the memory comprises a number of first estimates of the first controlled acoustic feedback path. Preferably, the number of first estimates correspond to different resulting output gains (reflecting different possible user needs).

In an embodiment, the hearing assistance device comprises a communication interface and/or a user interface. In an embodiment, the hearing assistance device is adapted to (e.g. in a specific data transfer mode) transfer data regarding the estimation of the current acoustic feedback path or said RECD-values at different frequencies (e.g. stored in said memory) to a programming device or to another device (e.g. a SmartPhone) via said communication interface. In an embodiment, the hearing assistance device is (e.g. in a specific measurement mode) configured to allow the acoustic feedback path measurement (and/or said RECD determination) to be initiated via the communication interface and/or via the user interface. In an embodiment, the user interface is established via a SmartPhone.

In an embodiment, the hearing assistance device comprises a noise level detector for determining a current level of acoustic noise in the environment of the hearing assistance device. In an embodiment, the hearing assistance device is adapted to use an additional input transducer (e.g. a microphone) other than the measurement input transducer to form part of said noise level detector. In an embodiment, the additional input transducer form part of the normal (environment) input transducers that are used to pick up an input sound signal during normal use of the hearing assistance device. In an embodiment, the hearing assistance device is adapted to use the current level of acoustic noise in the configuration of the probe signal, e.g. to determine the distance in time between the pure tones played at different frequencies in a 'pure tone stepped sweep'-type probe signal. Preferably, the time interval between adjacent tones increases with increasing noise level (to allow for a longer convergence time in a more noisy environment.

In an embodiment, the hearing assistance device comprises a BTE-part adapted for being located behind an ear (pinna) of the user and the ITE-part. In an embodiment, the measurement input transducer and the output transducer are located in the BTE-part. In an embodiment, the ITE-part comprises an ear mould. In an embodiment, the ITE-part is adapted to receive a (first) acoustic propagation element from the output transducer (of the BTE-part) to thereby allow propagation of the sound signal from the output transducer to the residual volume, when the ITE-part is operationally located at or in the user's ear canal.

In an embodiment, the hearing assistance device is adapted to provide a frequency dependent gain to compensate for a hearing loss of a user. In an embodiment, the hearing assistance device comprises a signal processing unit for enhancing the input signals and providing a processed output signal.

In an embodiment, the output transducer comprises a receiver (speaker) for providing the stimulus as an acoustic signal to the user.

The hearing assistance device comprises an environment input transducer for converting an input sound in the environment to an electric input signal. In an embodiment, the hearing assistance device comprises a directional microphone system adapted to enhance a target acoustic source among a multitude of acoustic sources in the local environment of the user wearing the hearing assistance device. In an embodiment, the measurement input transducer used in the measurement of the controlled feedback paths of the present disclosure aiming at determining a real ear to coupler difference is adapted specifically to this purpose, and possibly different from the environment input transducer(s) used for picking up sounds from the environment during normal operation of the hearing assistance device. In an embodiment, such environment input transducer(s) used during normal operation are inactive (muted) during RECD-measurements (in the specific probe signal mode). Alternatively, however, the environment input transducer(s) are used during (and/or prior to) performing the RECD-measurements to estimate a current noise level.

In an embodiment, the hearing assistance device comprises an antenna and transceiver circuitry for wirelessly receiving a direct electric input signal from another device, e.g. a communication device or another hearing assistance device. In an embodiment, the hearing assistance device comprises a (possibly standardized) electric interface (e.g. in the form of a connector, e.g. a DAI) for receiving a wired direct electric input signal from another device, e.g. an adapter comprising said measurement input transducer for use during RECD-measurements.

In an embodiment, the communication between the hearing assistance device and the other device is in the base band (audio frequency range, e.g. between 0 and 20 kHz). Preferably, communication between the hearing assistance device and the other device is based on some sort of modulation at frequencies above 100 kHz. Preferably, frequencies used to establish a communication link between the hearing assistance device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing assistance device is portable device, e.g. a device comprising a local energy source, e.g. a battery, e.g. a rechargeable battery.

In an embodiment, the hearing assistance device comprises a forward or signal path between an environment input transducer (microphone system and/or direct electric input (e.g. a wireless receiver)) and the output transducer. In an embodiment, the signal processing unit is located in the forward path. In an embodiment, the signal processing unit is adapted to provide a frequency dependent gain according to a user's particular needs. In an embodiment, the hearing assistance device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the hearing assistance devices comprise an analogue-to-digital (AD) converter to digitize an analogue input with a predefined sampling rate, e.g. 20 kHz. In an embodiment, the hearing assistance devices comprise a digital-to-analogue (DA) converter to convert a digital signal to an analogue output signal, e.g. for being presented to a user via an output transducer.

In an embodiment, the hearing assistance device comprises a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing assistance device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing assistance device is split into a number NI of frequency bands, where NI is e.g. larger than 5, such as larger than 10, such as larger than 50, such as larger than 100, such as larger than 500, at least some of which are processed individually. In an embodiment, the hearing assistance device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing assistance device comprises a level detector (LD) for determining the level of an input signal (e.g. on a band level and/or of the full (wide band) signal). The input level of the electric microphone signal picked up from the user's acoustic environment is e.g. a classifier of the environment.

The hearing assistance device comprises an acoustic (and/or mechanical) feedback suppression system. Adaptive feedback cancellation has the ability to track feedback path changes over time. It is e.g. based on a linear time invariant filter to estimate the feedback path where its filter weights are updated over time. The filter update may be calculated using stochastic gradient algorithms, including e.g. the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal. Various aspects of adaptive filters are e.g. described in [Haykin].

In an embodiment, the hearing assistance device further comprises other relevant functionality for the application in question, e.g. compression, noise reduction, etc.

In an embodiment, the hearing assistance device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing assistance device as described above, in the 'detailed description of embodiments' and in the claims, is moreover provided. In an embodiment, use is provided in a system comprising one or more hearing instruments, headsets, ear phones, active ear protection systems, etc. In an embodiment, use of a hearing assistance device in an RECD-measurement is provided.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing Assistance System:

In a further aspect, a hearing assistance system comprising a hearing assistance device as described above, in the 'detailed description of embodiments', and in the claims, AND an auxiliary device is moreover provided.

In an embodiment, the system is adapted to establish a communication link between the hearing assistance device and the auxiliary device to provide that information (e.g. measurement, control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing assistance device. In an embodiment, the auxiliary device is or comprises a remote control for controlling functionality and operation of the hearing assistance device(s). In an embodiment, the function of a remote control is implemented in a SmartPhone, the SmartPhone possibly running an APP allowing to control the functionality of the audio processing device via the SmartPhone (the hearing assistance device(s)

comprising an appropriate wireless interface to the SmartPhone, e.g. based on Bluetooth or some other standardized or proprietary scheme).

In an embodiment, the auxiliary device is or comprises a cellular telephone, e.g. a SmartPhone, or the like.

In an embodiment, the auxiliary device comprises a programming device (e.g. a fitting device) for assisting in fitting the hearing assistance device to a particular user's needs.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which:

FIG. 6 shows a flow diagram for a method of performing a real ear measurement in a hearing assistance device.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

FIG. 1 shows four embodiments of a hearing assistance device.

Figure 1A:
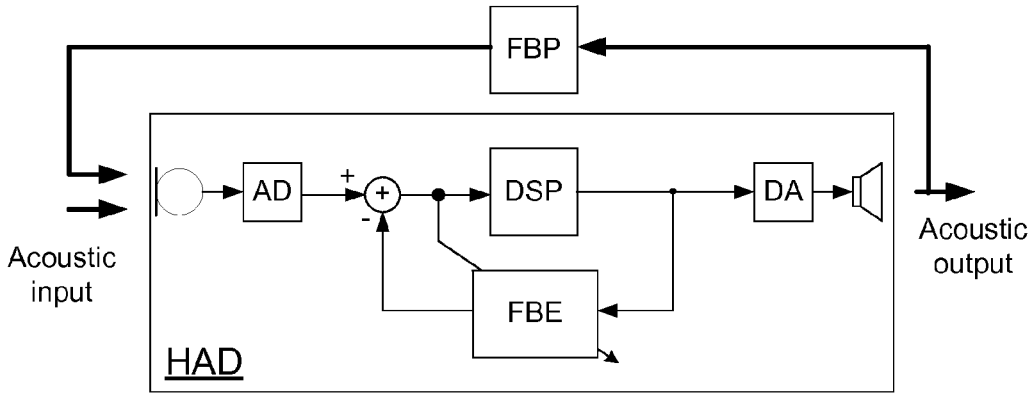
FIGS. 1A-1E show four embodiments of a hearing assistance device.
Figure 1B:
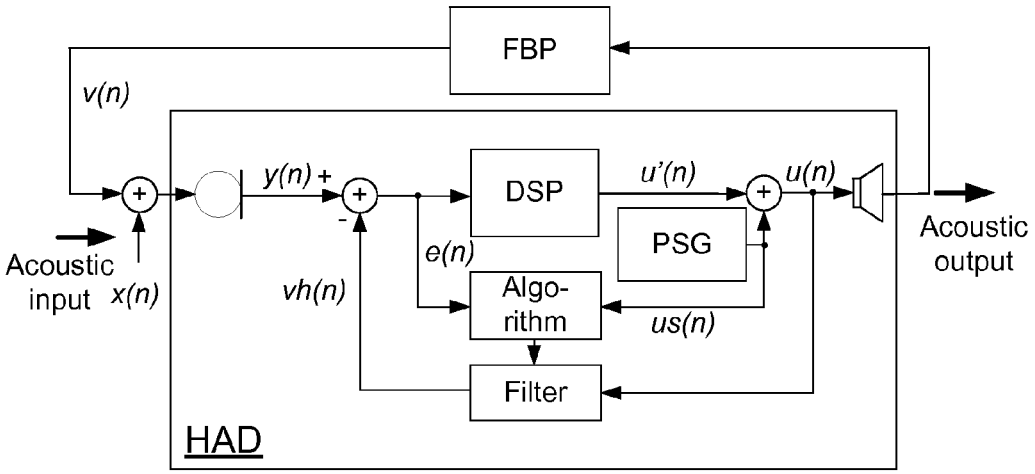

FIGS. 1A and 1B illustrates hearing assistance devices (HAD) in a normal mode of operation, where an input sound signal from the environment (denoted Acoustic input in FIG. 1 and comprising a target sound signal x(n) and an unintended feedback signal v(n), n being a time index indicating a time variation) is picked up by an input transducer and processed in a forward path to enhance the signal, and fed to an output transducer for being played to a user as an enhanced output sound signal (denoted Acoustic output in FIG. 1).

FIG. 1A shows a hearing assistance device (HAD) comprising a forward or signal path from an input transducer (e.g. as shown a microphone) to an output transducer (e.g. as shown a loudspeaker/receiver) and a forward path being defined there between and comprising a processing unit (DSP) for applying a frequency dependent gain to the signal picked up by the microphone and providing an enhanced signal to the loudspeaker. The hearing assistance device comprises a feedback cancellation system (for reducing or cancelling acoustic feedback from an 'external' feedback path (FBP) from output to input transducer of the hearing assistance device). The feedback cancellation system comprises an adaptive feedback estimation unit (FBE), e.g. in the form of an adaptive filter for estimating the feedback path from the output to the input transducer (here actually from the input to the digital to analogue (DA) converter (for converting the electric output signal to the loudspeaker to an analogue signal) to the output of the analogue to digital (AD) converter (for digitizing the electric input signal from the microphone). The feedback cancellation system further comprises a sum unit ('+') operatively coupled to the microphone and the output of the feedback estimation unit (FBE), and wherein the feedback path estimate is subtracted from the electric input signal from the microphone.

FIG. 1B shows a further embodiment, basically as the embodiment of FIG. 1A, but wherein the feedback estimation unit is shown as an adaptive filter comprising an algorithm part (Algorithm) and a variable filter part (Filter). The variable filter part is controlled by a prediction error algorithm, e.g. an LMS (Least Means Squared) algorithm, in the algorithm part in order to predict the part of the microphone signal that is caused by feedback (signal v(n) from the loudspeaker of the hearing assistance device). The prediction error algorithm uses a reference signal (e.g., as here, the output signal u(n)) together with a signal originating from the microphone signal (e(n)) to find the setting of the adaptive filter (Filter) that minimizes the prediction error when the reference signal is applied to the adaptive filter. The forward path of the hearing aid comprises during normal operation a signal processing unit (DSP), e.g. adapted to adjust the signal to the impaired hearing of a user (enhanced signal u'(n)). The estimate of the feedback path (vh(n)) provided by the adaptive filter is subtracted from the microphone signal (y(n)) in sum unit '+' providing the so-called 'error signal' (e(n), or feedback-corrected signal), which is fed to the processing unit DSP and to the algorithm part of the adaptive filter. To provide an improved de-correlation between the output and input signal, it may be desirable to add a probe signal to the output signal (cf. SUM unit ('+') combining enhanced signal u'(n) with probe signal us(n) to provide output signal u(n)). This probe signal (us(n)) can be used as the reference signal to the algorithm part (Algorithm) of the adaptive filter, as shown in FIG. 1*b* (output of block PSG in FIG. 1*b*), and/or it may be mixed with the output (u'(n)) of the processing unit (DSP) to form the reference signal (u(n)). In case the output of the processing unit (DSP) is disabled (as is the case during an RECD measurement, the output signal to the loudspeaker and the reference signal to the adaptive filter (u(n)) is equal to the probe signal (us(n)).

Figure 1C:
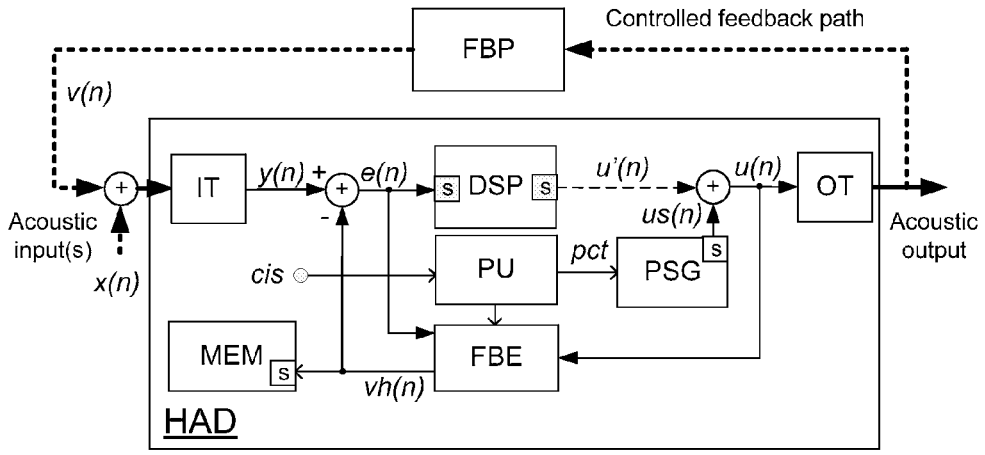
Figure 1D:
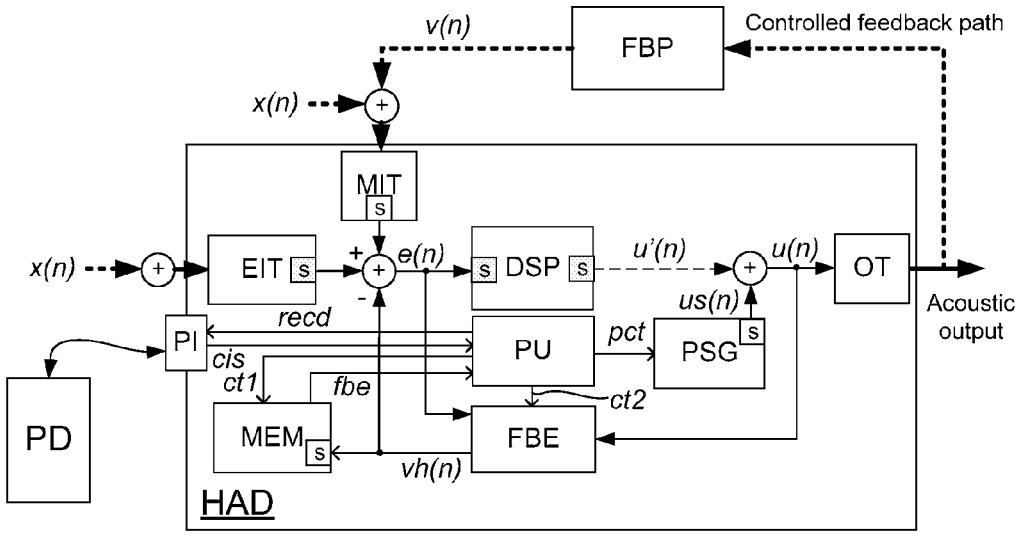
Figure 1E:
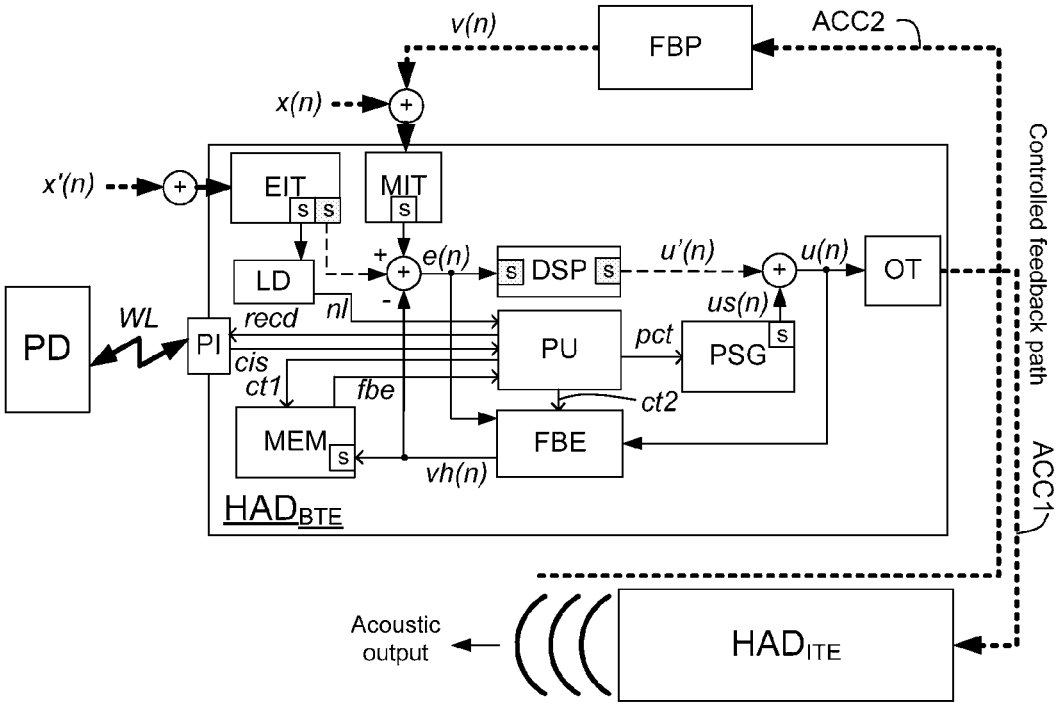

The feedback cancellation system (FBE, SUM-unit ('+')), the output transducer, which are normal components of a state of the art hearing assistance device, and the probe signal generator (PSG), which may be used during normal operation of the device, are used in the specific probe signal mode, where a RECD measurement is performed. FIGS. 1C, 1D and 1E illustrate embodiments of a hearing assistance device according to the present disclosure that are configured to switch between the normal mode of operation and the probe signal mode of operation. This functionality is provided by switches (s) inserted in the forward path at the input and output of the signal processing unit (DSP) allowing the signal processing unit to be disabled (switches s in an open state, output signal u'(n) indicated in dashed line) in the probe signal/measurement mode. In FIGS. 1*c*, 1*d* and 1*e*, a dark shading of switches s is intended to indicate to an open state (electric connected broken), whereas no shading is intended to indicate to closed state (electric connection shorted). The state of the switches is controlled via a control unit (e.g. control or processing unit (PU) in FIG. 1*c* via an internal control signal or in FIGS. 1*d*, 1*e* via an external control unit, e.g. via the interface to programming device (PD). In the probe signal (or measurement) mode, the input sound signal x(n) (in addition to the acoustic feedback signal v(n)) is considered as noise, and should preferably be minimized (to improve convergence rates of the adaptive algorithm and/or the accuracy of the estimate).

FIGS. 1C, 1D, and 1E show embodiments of a hearing assistance device (HAD) as discussed in 1A and 1B comprising switches (s) to control the configuration of the various functional components of the device. The (measurement) input transducer and the output transducer are denoted IT (FIG. 1C) or MIT (FIGS. 1D, 1E) and OT, respectively. In all three embodiment, the hearing assistance device is in a probe signal or measurement mode, where the signal processing unit (DSP) of the forward path is disabled (by open switches s) and the probe signal generator (PSG) is enabled (closed switch s) to play probe signal us(n) (=u(n)) via the output transducer (OD. A controlled feedback path (FBP) is established from the output transducer (OT) to the input transducer (IT, MIT), and an estimate of the controlled feedback path is provided by the feedback estimation unit (FBE). The resulting estimate is stored in the memory (MEM), which is electrically connected to the feedback estimation unit (FBE) (closed switch s).

In the embodiment of FIG. 1C, the configuration (mode of operation) of the functional blocks (switches s) is controlled by control unit (PU) based on input cis. The probe signal generator (PSG) is controlled via control signal pct, including the kind of probe signal and its initiation. The control unit (PU) is further configured to influence the feedback estimation unit (FBE), e.g. to decide a convergence time (when the feedback estimate is valid and ready to be stored in the memory MEM). In the embodiment of FIG. 1C, the input transducer (IT) used for measurement in a measurement mode is the same that is used in a normal mode of operation. Preferably, however, a specific measurement microphone adapted for the specific purpose is used.

This is illustrated in the embodiments of FIGS. 1D and 1E (input transducer MIT). The 'normal mode' input transducer IT in FIG. 1C is denoted EIT in FIGS. 1D, 1E, both input transducers being connected to switches s allowing one or both to be connected to and disconnected from the SUM-unit ('+').

In the embodiments of FIGS. 1D and 1E, a further difference to FIG. 1C is the presence of a communication interface (PI), e.g. as shown for establishing a wired (FIG. 1D) or wireless (FIG. 1E) connection to another device, here to a programming device (PD) allowing data to be exchanged between the hearing assistance device (HAD) and the programming device (PD, e.g. running a fitting software). Other devices than a programming device may be connected to the hearing assistance device via the communication interface (PI), e.g. a remote control, or other communication device, e.g. a cellular telephone, e.g. a SmartPhone. In the embodiments of FIGS. 1D and 1E, real ear to coupler values determined in the processing unit (PU) is forwarded to the communication interface (PI, e.g. to the programming device) via signal recd. In the embodiment of FIGS. 1D, 1E, the configuration (mode of operation) of the functional blocks (switches s) is controlled by control unit (PU) based on external input signal cis. The read and write of the feedback estimates (read (fbe), write (vh(n)) from and to, respectively, the memory is controlled by the processing unit (PU) via control signals ct1, ct2 (possibly initiated via the communication interface (PI) via control signal cis).

FIG. 1E shows an embodiment of a hearing assistance device (HAD) as shown in FIG. 1D (but where the link between the hearing assistance device and the other device is a wireless link (WL), e.g. an inductive link or based on radiated fields, e.g. according to Bluetooth (e.g. Bluetooth Low Energy). The hearing assistance device of FIG. 1E further comprises a noise detector for estimating a current acoustic noise level in the environment of the hearing assistance device. The noise detector is implemented by an input transducer (microphone) (EAT) and a level detector (LD). In a measurement mode, the (environment) microphone (EAT) is operatively connected to the level detector (LD). The level detector forwards a current noise level (represented by the level estimated from signal x(n) picked up by microphone EAT) to the processing unit (PU), cf. signal nl. The current noise level is preferably used to determine a level of the probe signal us(n) generated by the probe signal generator (PSG). The noise level may be provided at various frequencies (bands), and thus the level of the probe signal may be adapted individually in different frequency bands. In case the probe signal us(n) is a pure tone stepped sweep, the noise level may be used to influence the time between the excitation of successive pure tone signals (each representing a different frequency).

The hearing assistance device of FIG. 1E comprises a BTE-part ($HAD_{BTE}$) adapted for being located behind an ear (pinna) of the user and the ITE-part ($HAD_{ITE}$). In this embodiment, the measurement input transducer (MIT) and the output transducer (OT) are located in the BTE-part. The ITE-part comprises housing for insertion in the ear canal (e.g. an ear mould). The ITE-part is adapted to receive a (first) acoustic propagation element (ACC1), e.g. a tube, from the output transducer OT (of the BTE-part) to thereby allow propagation of the sound signal from the output transducer to the residual volume, when the ITE-part is operationally located at or in the user's ear canal (cf. indication 'Acoustic output←(((' to the left of the ITE-part ($HAD_{ITE}$) in FIG. 1E). The BTE-part is adapted to receive a (second) acoustic propagation element (ACC2), e.g. a tube, from the ITE part to the measurement input transducer MIT (of the BTE-part) to thereby allow propagation of the sound signal from the ITE-part/residual volume (when the ITE-part is operationally located at or in the user's ear canal) to the measurement input transducer MIT.

Figure 2A:
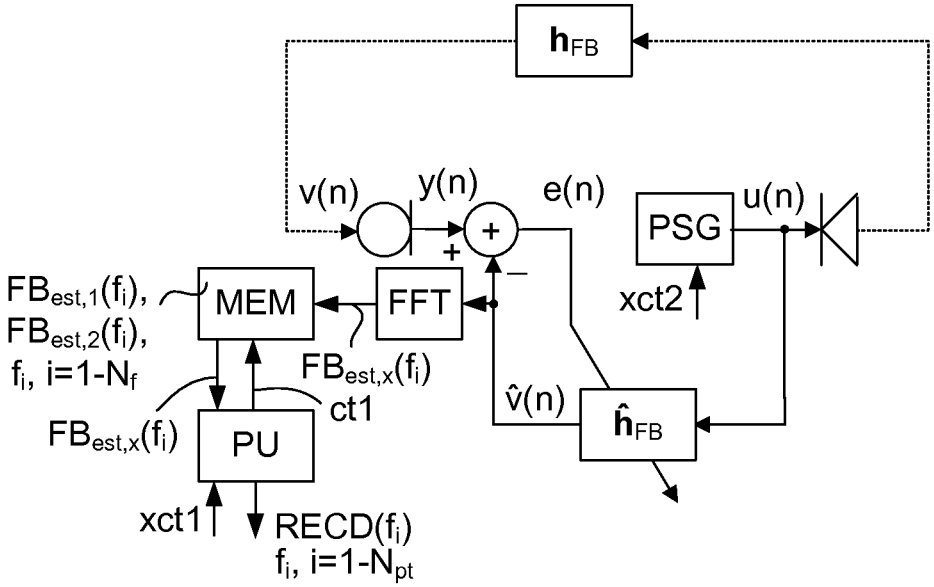
FIGS. 2A-2B show two embodiments of a hearing assistance device according to the present disclosure, FIG. 2A illustrating an embodiment comprising a general probe signal generator, FIG. 2B illustrating an embodiment comprising a probe signal generator in the form of a configurable pure tone generator, FIGS. 3A-3B schematically show two different probe signals for being played via the output transducer of the hearing assistance device and the resulting estimate of the acoustic feedback path, FIG. 3A showing a broad band type signal and FIG. 3B a pure tone type signal comprising successively playing a number of different pure tones and estimating the acoustic feedback path for each tone, FIGS. 4A-4B schematically show configurations of the hearing assistance device during determination of a real ear to coupler difference, FIG. 4A showing the coupler measurement, and FIG. 4B showing the real ear measurement.
Figure 2B:
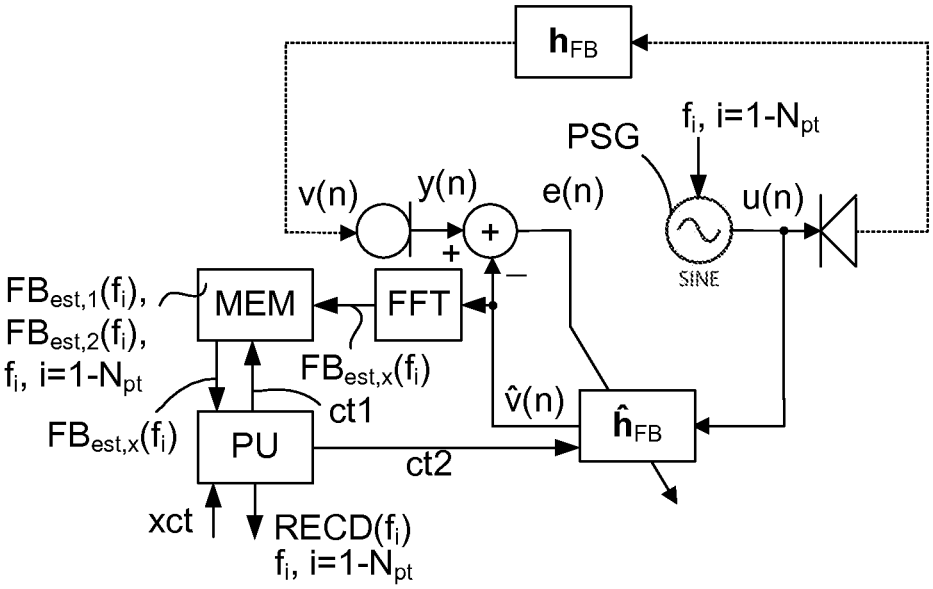

FIG. 2 shows two embodiments of a hearing assistance device according to the present disclosure, FIG. 2A illustrating an embodiment comprising a general probe signal generator, FIG. 2B illustrating an embodiment comprising a probe signal generator in the form of a configurable pure tone generator. The embodiments of FIG. 2 comprise the same elements as shown and discussed in connection with FIG. 1. However, the embodiments of FIGS. 2A and 2B each comprise a time to frequency conversion unit, here (fast) Fourier transformation unit (FFT) configured to provide the estimate of the acoustic feedback path $\hat{v}(n)$ determined by the feedback estimation unit $\hat{h}_{FB}$ at a number of frequencies $f_i$, $i=1, 2, \ldots, N_f$, where $N_f$ is the number frequencies considered. $FB_{est,1}(f_i)$, $FB_{est,2}(f_i)$, $i=1-N_f$, indicate that feedback estimates for the two different (controlled) feedback paths are stored in the memory (MEM). The processing unit (PU) is configured to determine a real ear to coupler difference $RECD(f_i)$, $i=1-N_f$ from the stored values $FB_{est,1}(f_i)$, $FB_{est,2}(f_i)$, $i=1-N_f$ of estimated acoustic feedback paths as $$RECD(f_i)=FB_{est,1}(f_i)-FB_{est,2}(f_i),\ i=1-N_f$$

Figure 3A:
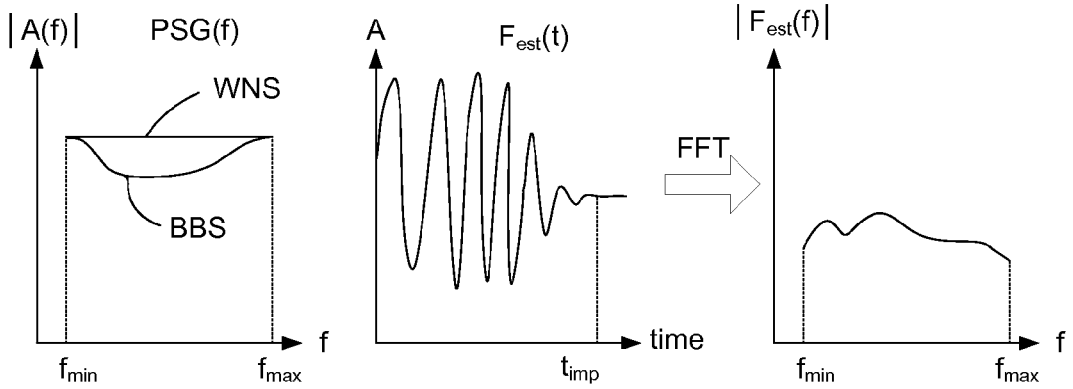

In the embodiment of FIG. 2A, the probe signal generator (PNG) is e.g. configured to generate a broad band probe signal u(n) comprising a range of frequencies Δf from a minimum frequency $f_{min}$ to a maximum frequency $f_{max}$, e.g. a white noise signal (cf. WNS in FIG. 3A). This has the advantage of comprising a range of frequencies allowing a feedback path to be estimated over said range of frequencies in one process (at the cost of a relatively long convergence time of the adaptive algorithm, however). The RECD values RECD ($f_i$) can e.g. be forwarded to another device, e.g. on request of a control signal xct1. The configuration and initiation of the probe signal generator (PSG) is controlled by control signal xct2. The transfer of data from the memory (MERM) is controlled by control signal ct1.

In the embodiment shown in FIG. 2B the probe signal generator (PSG) comprises a configurable pure tone generator (SINE), allowing a number $N_{pt}$ of pure tones at different frequencies $f_i$, $i=1, 2, \ldots, N_{pt}$ to be played by the output transducer, e.g. with a predefined time interval between each tone. In this case, the acoustic feedback path estimates $FB_{est,1}(f_i)$, $FB_{est,2}(f_i)$ are determined (at one frequency at a time) at the frequencies $f_i$, of the pure tones, $i=1-N_{pt}$. This has the advantage that each feedback estimate has a low convergence time (fast adaptation), but on the other hand that a number ($N_{pt}$) of estimates for each of the two controlled feedback paths has to be made. In the same way, the processing unit (PU) is configured to determine a real ear to coupler difference $RECD(f_i)$, $i=1-N_{pt}$, from the stored values $FB_{est,1}(f_i)$, $FB_{est,2}(f_i$, $i=1-N_{pt}$ of estimated acoustic feedback paths as $$RECD(f_i)=FB_{est,1}(f_i)-FB_{est,2}(f_i),\ i=1-N_{pt}$$

As mentioned in connection with FIG. 2A, the measurement can be initiated, stopped and results (RECD-values) provided as an output signal ($RECD(f_i)$, $i=1-N_{pt}$) by control signal(s) xct, ct1, ct2 (xct being possibly received from a remote device via a communication interface, cf. FIGS. 1D, 1E).

The stimulus and measurement procedure is further illustrated in FIG. 3.

FIG. 3 shows two different probe signals PSG(f) for being played via the output transducer (OT) of the hearing assistance device (HAD) and the resulting estimate $F_{est}$ of the acoustic feedback path in the time domain ($F_{est}(t)$) and in the frequency domain ($F_{est}(f)$).

FIG. 3A schematically illustrates a broad band type signal (WNS or BBS) comprising frequencies between a minimum frequency $f_{min}$ and a maximum frequency $f_{max}$. The left graph illustrates the magnitude $|A(f)|$ of the signals vs. frequency f. The white noise signal WNS has a constant magnitude over frequency, whereas the other broadband signal BBS has a varying magnitude over frequency. The amplitude of the broad band signal may in an embodiment be adapted to provide a fairly constant convergence rate of the adaptive feedback estimation algorithm over frequency, e.g. by increasing the amplitude of the broad band signal at frequencies where the transfer function of the feedback path is known to have a large attenuation (relative to other frequencies). The middle graph of FIG. 3A schematically shows an impulse response (amplitude A versus time) of the feedback path (as provided by a feedback estimation unit (FBE), e.g. an adaptive filter operating in the time domain). The impulse response ($F_{est}(t)$) is indicated to have a duration of $t_{Imp}$. The right graph in FIG. 3A schematically illustrates a frequency spectrum ($|F_{est}(f)|$) of the impulse response (as a result of a (fast) Fourier transformation, FFT).

Figure 3B:
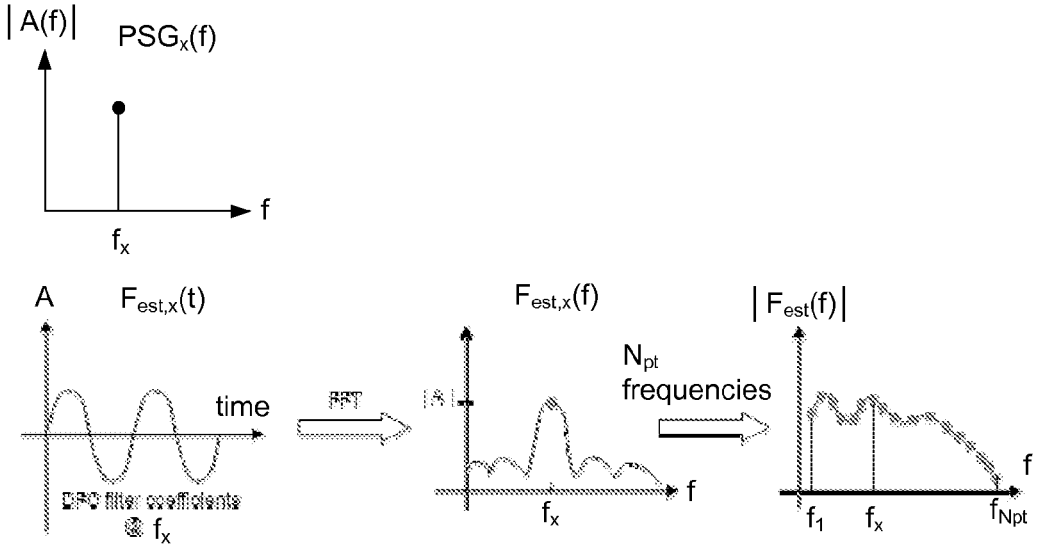

Correspondingly, FIG. 3B shows a stimulation and measurement procedure comprising a pure tone stepped sweep scheme, where a pure tone signal $PSG(f_x)$ comprising a single pure tone of frequency $f_x$, is played, and the feedback path is estimated at that frequency. The scheme comprises that a number ($N_{pt}$) of different pure tones are successively played, while estimating the acoustic feedback path for each tone. The top left graph in FIG. 3B show the amplitude $|A(f_x)|$ of a single pure tone at frequency $f_x$. The bottom left graph of FIG. 3B schematically shows an impulse response (amplitude A versus time) of the feedback path (as provided by a feedback estimation unit, e.g. as filter coefficients of an adaptive filter). The amplitude spectrum ($|F_{est}(f_x)|$ of the pure tone impulse response is shown in the middle graph of FIG. 3B. The resulting frequency spectrum ($|F_{est}(f)|$) comprising the amplitude ($|F_{est}(f_x)|$) of each pure tone feedback estimate (@fx=$f_1$, $f_2$, . . . , $f_{Npt}$) is schematically shown in the right graph in FIG. 3B (cf. individual dots on the graph).

FIG. 4 schematically shows configurations of the hearing assistance device (HAD) during determination of a real ear to coupler difference. The hearing assistance device comprising a BTE-part ($HAD_{BTE}$) and an ITE-part ($HAD_{ITE}$) as described in connection with FIG. 1E. The BTE-part comprises the output transducer and the measurement input transducer. The acoustic output (providing signal AcOUT) of the output transducer is acoustically coupled to a first acoustic propagation element (ACC1) having a first acoustic transfer function H1. The acoustic input (picking up signal AcIN) of the measurement input transducer is acoustically coupled to a second acoustic propagation element (ACC2) having a second acoustic transfer function H2. Ambient noise from the environment (forming part of (mixed with) the acoustic input signal (AcIN) is indicated by arrows denoted noise. In an embodiment, the first and/or second acoustic propagation element(s) comprise(s) a tube, at least over a part of its longitudinal extension. Preferably, the hearing assistance device and/or the acoustic propagation elements is/are adapted to provide that the acoustic propagation elements are coupled as tightly as possible (i.e. acoustically sealed) to input and/or output transducers of the hearing assistance device and/or the standard coupler.

Figure 4A:
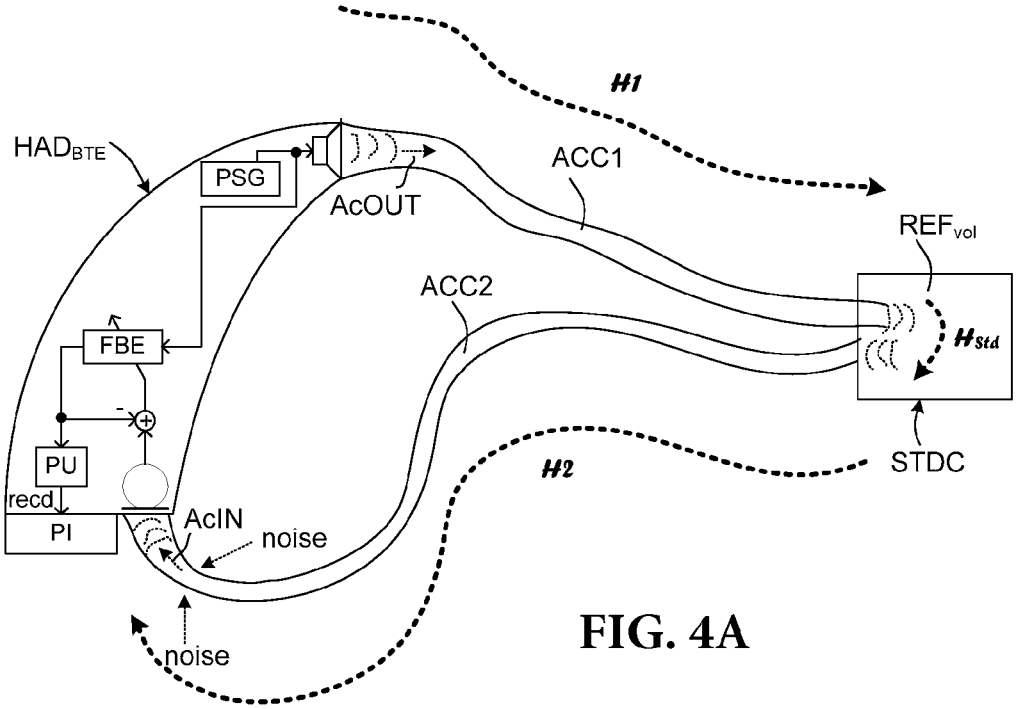

FIG. 4A shows the coupler measurement, where the first controlled acoustic feedback path from the output transducer to the measurement input transducer via a standard acoustic coupler (STDC) via first and second acoustic propagation elements (ACC1, ACC2). The transfer function from the input to the output of the reference volume $REF_{vol}$ (e.g. a 2-cc coupler) is denoted $H_{std}$. The transfer function from the output transducer to the measurement input transducer, i.e. the transfer function for the acoustic feedback path $F_{est,1}(f)$, can thus (in a logarithmic expression) be expressed as:

$$F_{est,1}(f)=H1(f)+H_{Std}(f)+H2(f).$$

While so coupled, the probe signal generator (PSG) generates a first probe signal (cf. e.g. FIG. 3), which is played into the first acoustic propagation element (ACC1) and propagated through the coupler and the second the feedback acoustic propagation element (ACC2), picked up by the measurement microphone. An estimate of the first controlled acoustic feedback path $F_{est,1}(f)$ is provided by the feedback estimation unit (FBE) and stored in a memory of the hearing assistance device (e.g. in the processing unit PU) and/or transferred to another device via the communication interface (PI).

Figure 4B:
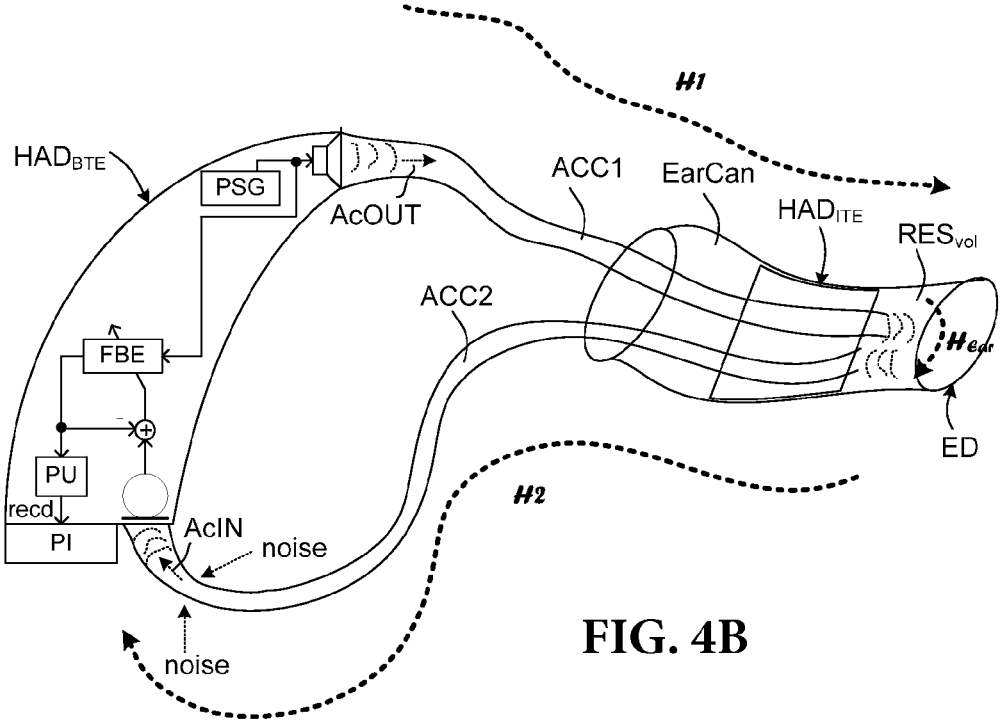

Similarly, FIG. 4B shows the real ear measurement, where the first controlled acoustic feedback path from the output transducer to the measurement input transducer via the ear canal (EarCan) and the residual volume between the ITE-part ($HAD_{ITE}$) of the hearing aid device and the user's eardrum (ED) via the first and second acoustic propagation elements (ACC1, ACC2). The transfer function from the input to the output of the residual volume $RES_{vol}$ of the ear is denoted $H_{Ear}$. The transfer function from the output transducer to the measurement input transducer, i.e. the transfer function for the acoustic feedback path $F_{est,2}(f)$, can thus be expressed as:

$$F_{est,2}(f)=H1(f)+H_{Ear}(f)+H2(f).$$

While so coupled, the measurement procedure as described for the coupler measurement is repeated. An estimate of the second controlled acoustic feedback path $F_{est,2}(f)$ is thus provided by the feedback estimation unit (FBE) and stored in a memory of the hearing assistance device (e.g. in the processing unit PU) and/or transferred to another device via the communication interface (PI).

The real ear to coupler difference $RECD(f)=H_{ear}(f)-H_{std}(f)$ is thus determined as $F_{est,2}(f)-F_{est,1}(f)$, because the transfer functions of the acoustic propagation elements (ACC1, ACC2) (assumed identical in the two measurements) cancel out (to a first approximation).

FIG. 5 shows various aspects of a probe signal comprising a pure tone steeped sweep with a view to environment noise level and convergence rate of the adaptive algorithm used in the feedback estimation unit.

Figure 5A:
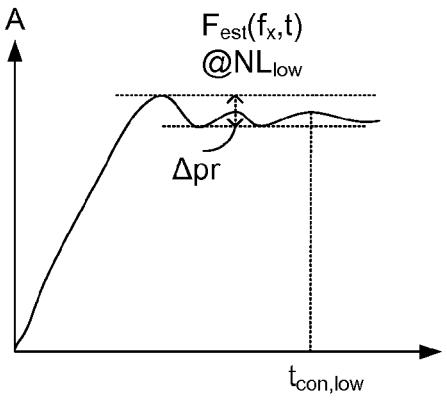
FIGS. 5A-5D show various aspects of a probe signal comprising a pure tone steeped sweep with a view to environment noise level and convergence rate of the adaptive algorithm used in the feedback estimation unit.
Figure 5B:
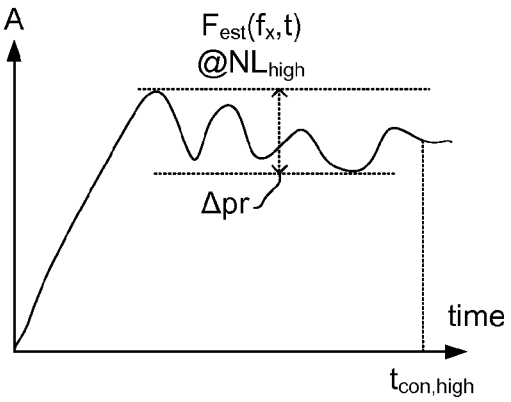

FIGS. 5A and 5B schematically show examples of convergence course over time of a feedback estimate $F_{est}(f_x,t)$ (magnitude A(t), e.g. for a pure tone stimulation at frequency $f_x$) provided by an adaptive feedback algorithm in a relatively quiet environment (low ambient noise level (NL), denoted @$NL_{low}$) (FIG. 5A) and in a relatively noisy environment (high ambient noise level (NL), denoted @$NL_{high}$) (FIG. 5B). It is seen that the convergence time $t_{con}$ (the time it takes for the algorithm to reach a (relatively) stable end value, representing a predefined precision) is larger in the noisy ($t_{con,high}$) than in the quiet ($t_{con,low}$) environment. This is illustrated by the larger transient oscillations (Δpr) in the noisy than in the quiet environment.

Figure 5C:
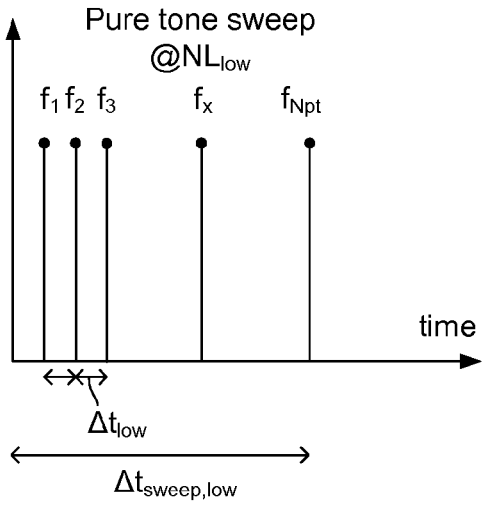
Figure 5D:
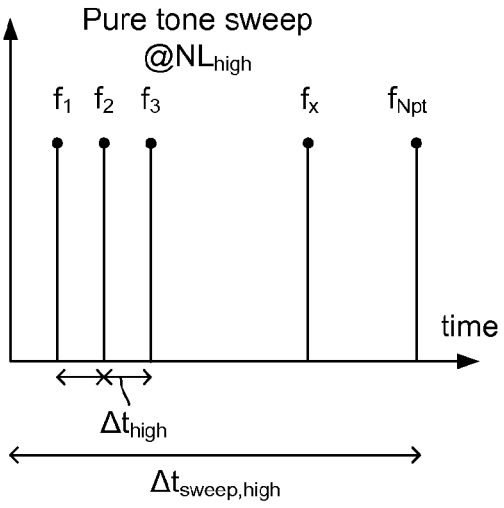

FIGS. 5C and 5D schematically show examples of pure tone steeped sweep signals, where the time interval Δt between successive pure tone frequencies is adapted to the environment noise level. FIG. 5C illustrates the timing of a series of pure tones in a relatively quiet environment (low ambient noise level (NL), denoted @$NL_{low}$), and FIG. 5D illustrates the timing of a series of pure tones in a relatively noisy environment (high ambient noise level (NL), denoted @$NL_{high}$). The time interval Δt between successive pure tone frequencies is larger in the relatively noisy environment ($\Delta t_{high}$) than in the relatively quiet environment ($\Delta t_{low}$), resulting in a corresponding relatively higher ($\Delta t_{sweep,high}$) and relatively lower ($\Delta t_{sweep,low}$) accumulated sweep time, respectively. Such schemes can conveniently be controlled by using an a noise level detector as indicated in FIG. 1E.

The method of the present disclosure can in its broadest aspect be described with two different stimulation signals (broad band and pure tone steeped sweep, as also discussed in connection with FIG. 3):

1. Broad Band:

a. Generate broad band noise as output (to the output transducer)

b. Estimate impulse response c. Perform FFT on impulse response.

d. Repeat step a-c in 2-cc and real ear and subtract results to get RECD.

2. Pure Tone Stepped Sweep a. Generate pure tone as output at first desired frequency b. Estimate impulse response c. Perform FFT on impulse response and store result at desired frequency d. Repeat step a-c at all desired frequencies e. Repeat step a-d in both real ear and 2-cc coupler and subtract results to get RECD.

FIG. 6 shows a flow diagram for a specific method of performing a real ear measurement in a hearing assistance device. The method according to the present disclosure comprises the steps of:

a1) providing a first controlled acoustic feedback path from the output transducer to the input transducer of a hearing assistance device via a standard acoustic coupler;

b1) generating a first probe signal, and playing it via said output transducer;

c1) estimating and storing a first estimate of the first controlled acoustic feedback path;

a2) arranging an ITE part of the hearing assistance device at or in an ear canal of a user and providing a second controlled acoustic feedback path from the output transducer to the input transducer of the hearing assistance device via the residual volume between the ITE part and the user's eardrum;

b2) generating a second probe signal, and playing it via said output transducer;

c2) estimating and storing a second estimate of the second controlled acoustic feedback path; and e) determining a real ear to coupler difference from said first and second acoustic feedback estimates.

In an embodiment, the probe signal is a combination of different pure tones played at the same time (and possibly repeated with a predefined time interval), e.g. as a small melody or jingle.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

U.S. Pat. No. 7,634,094 (BERNAFON) Feb. 3, 2006
US2007009107A1 (WIDEX) Nov. 1, 2007
[Haykin] S. Haykin, Adaptive filter theory (Fourth Edition), Prentice Hall, 2001.

The invention claimed is:

1. A method of performing a real ear measurement in a hearing assistance device comprising an ITE part adapted for being located at or in an ear canal of a user, a measurement input transducer that is a microphone of an adapter connected to the hearing assistance device, and a direct audio input for converting an input sound signal to an electric input signal, an output transducer for converting an electric output signal to an output sound, a feedback estimation unit for estimating an acoustic feedback path from the output transducer to the measurement input transducer, the feedback estimation unit providing first and second impulse responses of first and second controlled acoustic feedback paths, a memory for storing one or more acoustic feedback estimates, a processing unit operatively connected to the memory, and a probe signal generator for generating a probe signal, the probe signal generator being operatively connected to the output transducer, at least in a specific probe signal mode, the method comprising:

providing the first controlled acoustic feedback path from the output transducer to the measurement input transducer via a standard acoustic coupler;

generating a first probe signal;

estimating and storing a first estimate of the first controlled acoustic feedback path; and providing the second controlled acoustic feedback path from the output transducer to the measurement input transducer of said adapter connected to the hearing assistance device via the residual volume between the ITE part of the hearing aid device and the user's eardrum via a probe tube acoustically coupled to the ear canal;

estimating and storing a second estimate of the second controlled acoustic feedback path; and determining a real ear to coupler difference from said first and second acoustic feedback estimates.

2. A method according to claim 1 comprising adaptively estimating an acoustic feedback path from the output transducer to the measurement input transducer.

3. A method according to claim 1 wherein estimating an acoustic feedback path comprises estimating an impulse response for a signal transmitted from the output transducer to the measurement input transducer.

4. A method according to claim 1 wherein estimating an acoustic feedback path comprises providing an estimate of the transfer function of the feedback path at a number of frequencies.

5. A method according to claim 4 wherein the real ear to coupler difference is determined at different frequencies based on the difference between said first and second frequency domain signals at different frequencies.

6. A method according to claim 1 wherein the first or second probe signal is a broad band signal.

7. A method according to claim 4 wherein the first or second probe signals comprise a pure tone stepped sweep, and wherein for each pure tone frequency, the magnitude of a frequency domain signal representing the feedback path estimate at that frequency is determined.

8. A method according to claim 7 wherein steps a1) to c1) and a2) to c2) are performed for the first and second controlled acoustic feedback paths, respectively, for each pure tone frequency $f_x$, x=1, 2, . . . , $N_{pt}$, where $N_{pt}$ is the number of pure tones.

9. A method according to claim 1 wherein the level of the first and second probe signals is controlled in dependence on the current noise level around the hearing assistance device.

10. A hearing assistance device, comprising:

an ITE part adapted for being located at or in an ear canal of a user;

a direct audio input operatively coupled to an adapter, the adapter including a measurement input transducer for converting an input sound signal to an electric input signal;

an output transducer for converting an electric output signal to an output sound;

a feedback estimation unit for estimating an acoustic feedback path from the output transducer to the measurement input transducer;

a memory for storing one or more acoustic feedback estimates;

a processing unit operatively connected to the memory; and a probe signal generator for generating a probe signal, the probe signal generator being operatively connected to the output transducer, wherein at least in a specific probe signal mode, the hearing assistance device is configured to connect a first acoustic propagation element and a second acoustic propagation element to said output transducer and to said measurement input transducer, respectively, the memory stores an estimate of a reference acoustic feedback path via a standard coupler, and the hearing assistance device—in said specific probe signal mode—is configured to initiate a feedback measurement by feeding the probe signal to the output transducer and receiving a resulting feedback signal by said measurement transducer, and further configured to—after a certain convergence time—store in said memory an estimate of a current acoustic feedback path determined by said feedback estimation unit, and further configured to determine a real ear to coupler difference from said reference feedback path and said estimate of the current acoustic feedback path.

11. A hearing assistance device according to claim 10 comprising an adaptive filter.

12. A hearing assistance device according to claim 10 wherein the feedback estimation unit is configured a) to operate in the time domain to estimate an impulse response for a signal transmitted from the output transducer to the measurement input transducer or b) to operate in the frequency domain to provide a feedback path estimate at a number of predefined frequencies.

13. A hearing assistance device according to claim 10 comprising first and second acoustic propagation elements to form part of controlled feedback paths and configured to guide a) sound from an acoustic output of the output transducer to a standard acoustic coupler or to a residual volume between said ITE-part and the user's eardrum, and b) sound from an acoustic output of a standard acoustic coupler or from the residual volume between the ITE-part and the user's eardrum to an acoustic input of the measurement input transducer, respectively.

14. A hearing assistance device according to claim 10 comprising a communication interface and/or a user interface.

15. A hearing assistance device according to claim 10 comprising a noise level detector for determining a current level of acoustic noise in the environment of the hearing assistance device.

16. Use of a hearing assistance device as claimed in claim 10 in an RECD-measurement.

17. A hearing assistance device according to claim 10, comprising a hearing aid.

* * * * *